United States Patent [19]

Pringle

[11] Patent Number: 4,574,889

[45] Date of Patent: Mar. 11, 1986

[54] METHOD AND APPARATUS FOR LOCKING A SUBSURFACE SAFETY VALVE IN THE OPEN POSITION

[75] Inventor: Ronald E. Pringle, Houston, Tex.

[73] Assignee: Camco, Incorporated, Houston, Tex.

[21] Appl. No.: 710,642

[22] Filed: Mar. 11, 1985

[51] Int. Cl.[4] ..... E21B 34/10; E21B 23/00

[52] U.S. Cl. ..... 166/386; 166/323

[58] Field of Search ..... 166/386, 322, 323, 55, 166/332–334, 55.1; 72/112, 120, 391

[56] References Cited

U.S. PATENT DOCUMENTS

| | | | |
|---|---|---|---|
| 3,696,868 | 10/1972 | Taylor, Jr. | 166/375 |
| 3,786,865 | 1/1974 | Tausch et al. | 166/322 |
| 3,786,866 | 1/1974 | Tausch et al. | 166/322 |
| 3,882,935 | 5/1975 | Calhoun | 166/323 X |
| 3,886,967 | 6/1975 | Nelson | 166/323 X |
| 3,981,358 | 9/1976 | Walkins et al. | 166/323 X |

*Primary Examiner*—Stephen J. Novosad

*Assistant Examiner*—Thuy M. Bui

*Attorney, Agent, or Firm*—Fulbright & Jaworski

[57] ABSTRACT

A method and apparatus for locking out a subsurface well safety valve in the open position in which the valve includes a housing having a bore and at least one downwardly directed shoulder adjacent the bore with a valve closure member in the bore moving between open and closed positions, and a flow tube telescopically movable in the housing for controlling the movement of the valve closure member. The method includes engaging the flow tube from the bore, moving the flow tube towards the open position, and from the inside of the bore making one or more outward indentations in the flow tube at a predetermined location whereby the indentations will engage a downwardly directed shoulder on the housing thereby preventing the flow tube from moving through the closed position. The indentations may be made around the outer circumference of the flow tube, circularly positioned, and at a predetermined distance from the top of the flow tube.

10 Claims, 4 Drawing Figures

METHOD AND APPARATUS FOR LOCKING A SUBSURFACE SAFETY VALVE IN THE OPEN POSITION

BACKGROUND OF THE INVENTION

Various types of subsurface well safety devices are utilized in a well tubing to shut off the production of well fluids from oil or gas wells in which the opening and closing of the valve is controlled by movement of a flow tube. However, the well safety valve may fail from various causes. If the safety valve is retrievable, it must be removed and repaired, but if it forms a portion of the well tubing the tubing string must be pulled to perform any safety valve repairs.

Such operations are costly and time-consuming. It is sometimes desirable to delay the repair of the safety valve but still work on or produce from the well. To do this, the safety valve is locked out, which means it is mechanically moved to the fully opened position for the purpose of producing from the well or performing other work in the tubing below the safety valve. While a lock-out of the safety valve will not eliminate the need for pulling the safety valve or tubing for repair, the lock-out will allow the well to stay on production or perform other work functions in the tubing until the safety valve can be conveniently scheduled. Various types of mechanical lock-outs have been proposed in U.S. Pat. Nos. 3,696,868; 3,786,865; and 3,786,866. However, the use of such mechanical lock-outs increases the cost of the safety valve. In addition, the lock-outs are not used approximately 99% of the time. Furthermore, the mechanical lock-outs, since they are not operated for extended periods of time, for instance years, and are not operated normally or periodically; may themselves fail for various reasons such as sand buildup.

The present invention is directed to a method and apparatus for locking out a subsurface safety valve in the open position in which the usual mechanical lock-out may be omitted. This is achieved by making one or more outward indentations in the flow tube after it is moved towards the open position and opens the valve closure member, whereby the indentations will engage a downwardly directed shoulder on the valve housing thus preventing the flow tube and the valve from moving to the closed position.

SUMMARY

The present invention is directed to a method and apparatus of locking out a subsurface well safety valve in the open position in which the valve includes a housing having a bore and at least one downwardly directed shoulder adjacent the bore and a valve closure member in the bore moving between open and closed positions, a flow tube telescopically movable in the housing for controlling the movement of the valve closure means, and means for operating the flow tube. The method includes moving the flow tube towards its open position, and from the inside of the bore making an outward indentation in the flow tube at a predetermined location whereby the indentation will engage a downwardly directed shoulder in the housing thereby preventing the flow tube from moving to the closed position.

Still a further object of the present invention is the method of making a plurality of indentations around the outer circumference of the flow tube.

Yet a further object is wherein the indentations are placed a predetermined distance from the top of the flow tube.

A further object is wherein the indentations are circularly positioned about the flow tube.

A further object includes moving the flow tube downwardly by engaging and mechanically moving the flow tube.

Still a further object includes measuring the distance the flow tube is moved for placing the indentations at the proper location for preventing the flow from moving to the closed position.

Yet a still further object of the present invention is the provision of means for locking out a subsurface safety valve in the open position in which the valve includes a housing having a bore and at least one downwardly directed shoulder adjacent the bore, and a valve closure member in the bore moving between open and closed positions, and a flow tube telescopically movable in the housing for controlling the movement of the valve closure member. The means includes a body adapted to move into the bore of the safety valve, means on the body adapted to engage the flow tube and move the flow tube towards the open position, and means on the body for making at least one outward indentation in the flow tube at a predetermined location in the flow tube. The apparatus may further include means for making the indentations a predetermined distance from the top of the flow tube and means for measuring the distance the flow tube is moved towards the open position.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
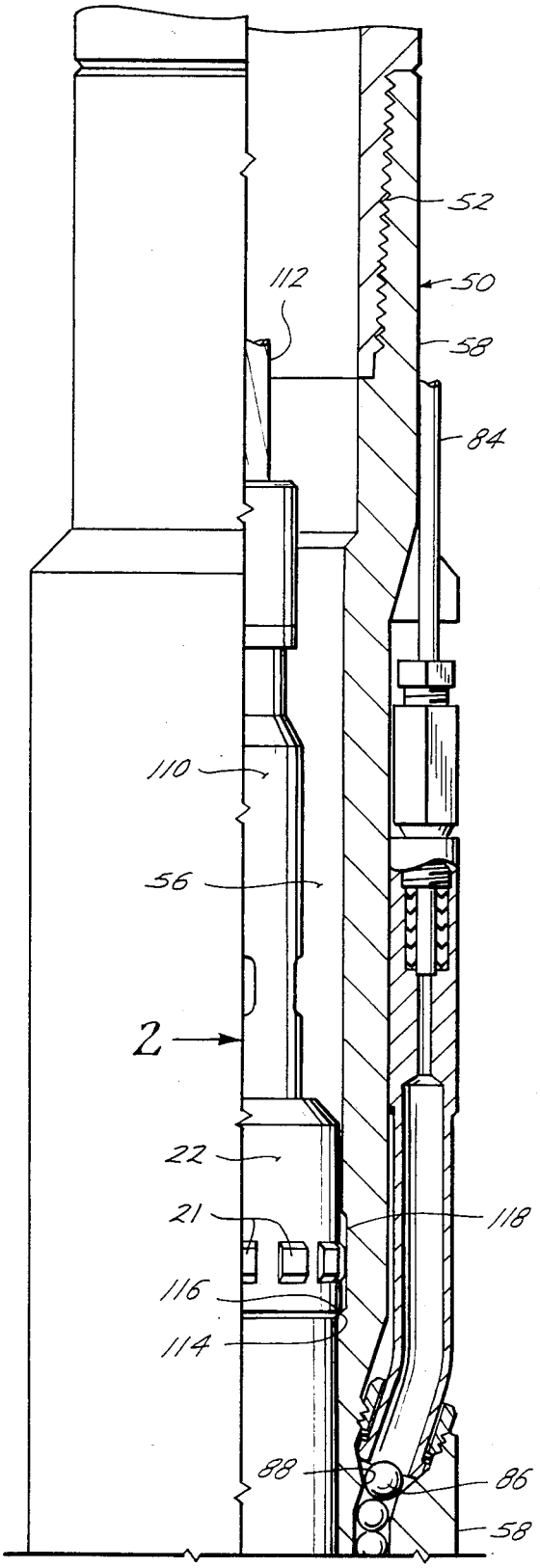
FIGS. 1A, 1B, and 1C are continuations of each other and are an elevational view, in quarter section, of the method and apparatus of the present invention in a subsurface well safety valve.

For purposes of illustration only, the present invention will be described in connection with a particular tubing retrievable flapper safety valve. However, it is to be understood that the present invention may be used with other types of safety valves including those having different type valve closure means.

Referring now to the drawings, the reference numeral 50 generally includes a well safety valve of the tubing retrievable type adapted to form a portion of a well tubing by being connected therein by suitable threaded connections 52 and 54. The safety valve 10 is provided to control the fluid flow through a bore 56 in a valve housing 58. Under normal flow conditions, the valve 10 is in the open position but the valve 10 is closed when desired.

Figure 1B:
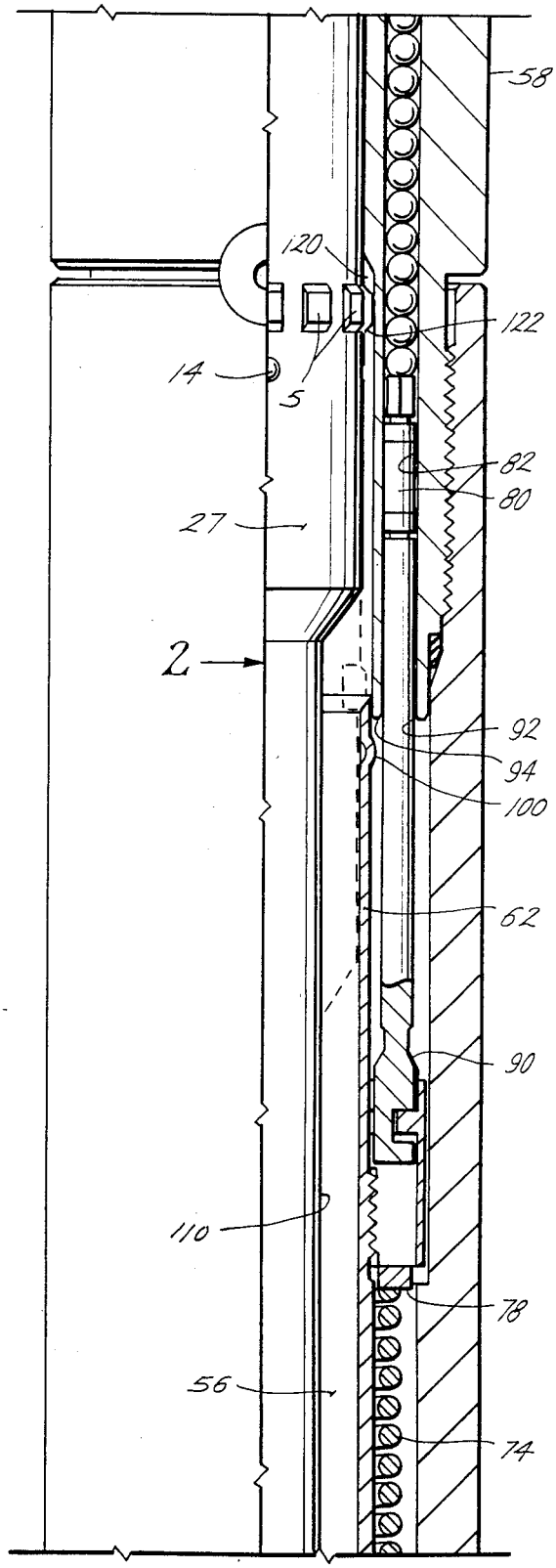
Figure 1C:
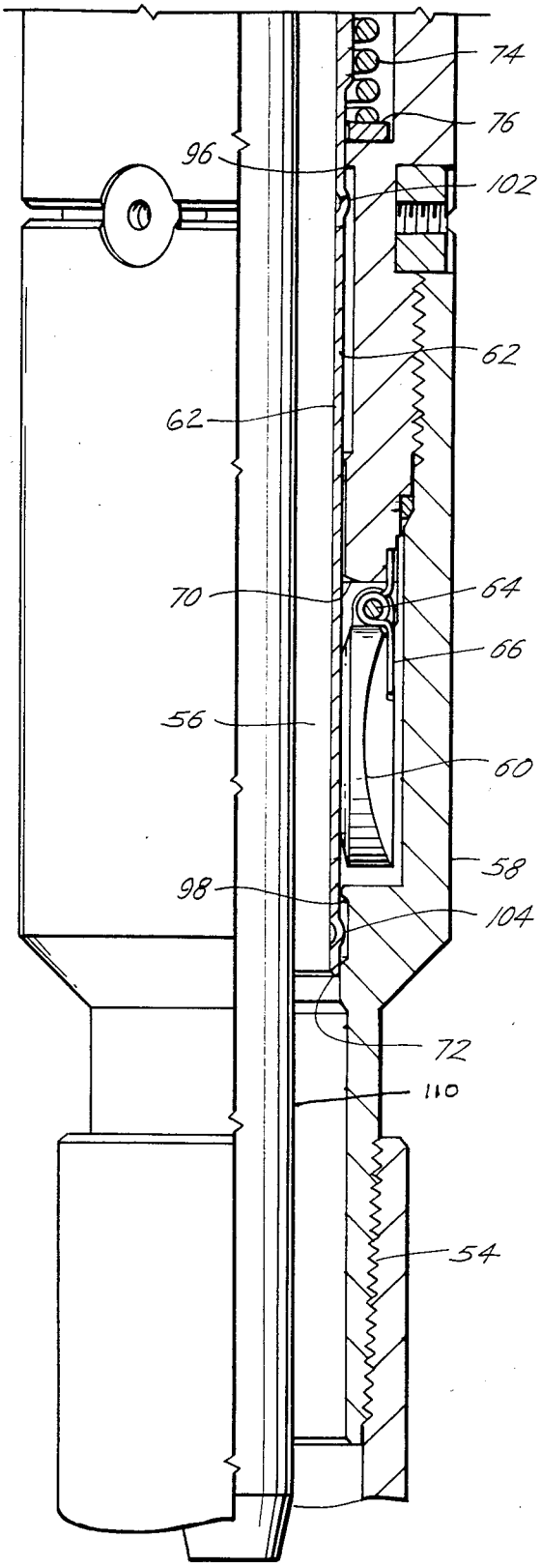
Figure 2:
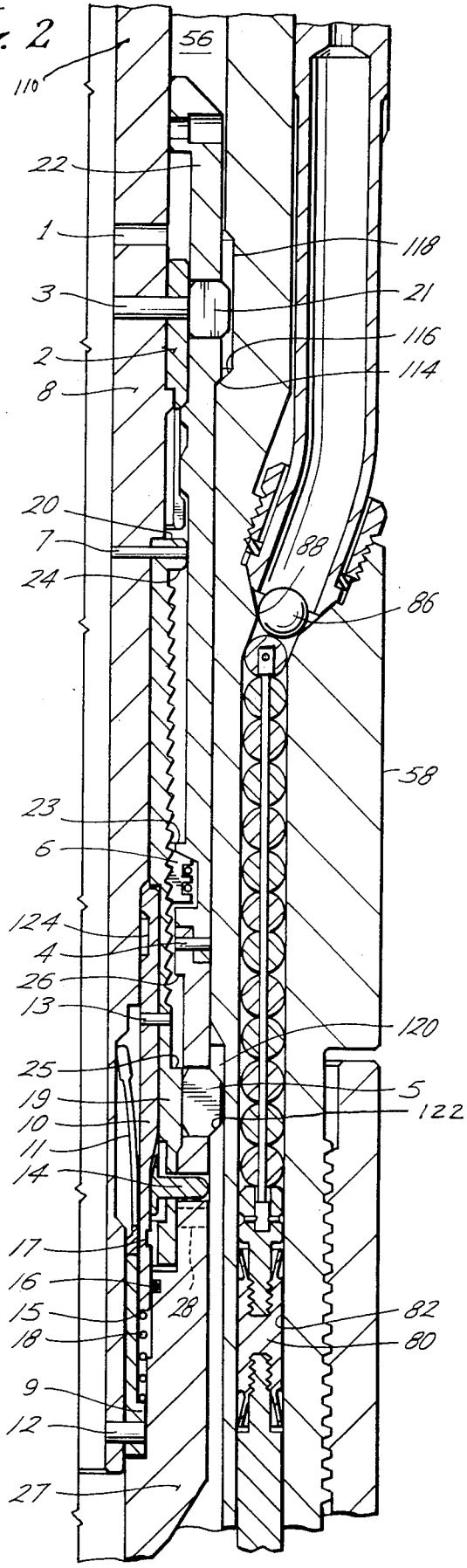
FIG. 2 is an enlarged fragmentary elevational view, in cross section, illustrating one type of tool for making indentations.

The valve 10 includes, as best seen in FIG. 1C, a valve closure member such as a flapper valve 60, and a tubular member or flow tube 62 telescopically movable in the housing 58. The flapper 60 is carried about a pivot 64 and may include a spring 66 for yieldably urging the valve closure member 60 onto an annular valve seat 70 for closing the valve and blocking upward flow of fluid through the bore 56 of the valve 10.

The flow tube 62 is longitudinally movable in the valve body 58 and when the lower end 72 is moved downwardly, the end 72 contacts the flapper 60 moving the flapper 60 off of the valve seat 70 and into a downward and open position. However, when the flow tube 62 is moved upwardly and its lower end 72 is moved above the valve seat 70, the valve closure member 60 seats, shutting off flow through the bore 56.

Various control means are provided for controlling the movement of the flow tube 62. For example, a biasing spring 74 may be positioned betweeh a shoulder 76 on the valve body 58 and a shoulder 78 on the flow tube 62 for biasing the flow tube 62 upwardly. In order to provide for moving the flow tube in a downward direction a piston 80 may be provided connected to the flow tube 62 for movement in a cylinder 82. If fluid pressure is applied through a line 84 leading to the well surface the control fluid flows to the cylinder 82 for controlling the movement of the piston 80 and thus of the flow tube 62. When fluid is applied against the piston 40, the flow tube 62 is moved downwardly overcoming a biasing spring 74 and any well pressure in the bore 76 and opens the valve closure member 60. The valve closure member 60 is closed by reducing the fluid pressure in the control line 84 and thus in the cylinder 82 allowing the biasing spring 74 and well pressure to move the piston 80 and flow tube 62 upwardly releasing the valve closure member 60. While the piston 80 may be of any suitable type, it is here shown as a metal cup piston which leaks a slight amount of fluid and therefore an upper valve member 86 seats on a seat 88 when the valve moves to the open position to close off fluid flow through the cylinder 82. Similarly, as best seen in FIG. 1B, a valve element 90 is connected to the piston 80 for seating on a valve seat 92 for shutting off fluid flow through the cylinder 82 when the valve is in the closed position.

It is to be noted that the housing 58 includes one or more downwardly directed shoulders adjacent the flow tube 62 such as shoulder 94 (FIG. 1B), shoulder 96 (FIG. 1C) and shoulder 98 (FIG. 1C).

While the above description describes one type of well safety valve 10, the present invention may be used in various types of safety valves which utilize a flow tube to open and close the safety valve.

However, in the event that the safety valve 10 becomes inoperative and the flow tube 62 is in the upper or partially upward position, it may be desirable to lock out the safety valve. However, the safety valve 10 is locked out by holding the valve closure member 60 in the full open position for purposes of allowing well production or performing various types of through tubing work until the valve 10 may be conveniently retrieved and repaired. The prior art utilizes various mechanical lock-out means such as described in U.S. Pat. Nos. 3,696,868; 3,786,865; and 3,786,866 which are actuated to hold the valve closure member in the open position. However, such mechanisms increase the expense of the valve 10 and increase the complexity of manufacture. Furthermore, lock-outs are generally used only 1% of the time and during that time they are not functioned normally or periodically and remain inactive for extended periods of time, such as years. In the event that they are actuated after a long period of inactivity, they may have sanded up or may fail for other reasons.

The present invention is directed to utilizing a method and apparatus for locking out a well safety valve without requiring the use of a conventional mechanical lock-out. The present invention is directed to moving the flow tube 62 downwardly for opening the valve closure member 60 and thereafter placing one or more outward indentations 100, 102, and 104 in the flow tube 62 at a predetermined location for engaging one of the shoulders 94, 96 and 98 on the housing 58 for thereafter preventing the flow tube to move upwardly into the closed position. The indentations extend outwardly from the outer circumference of the well tube and may include a plurality of indentations which are circularly positioned about the circumference of the flow tube. As the indentations must be placed in the flow tube 62 at a predetermined position to coact with the downwardly directed shoulders on the housing, one method of locating the indentations is by placing them a predetermined distance from the top of the flow tube 62. The distances from the top of the flow tube or the predetermined location will accurately be known if the flow tube is in the open position. However, in some cases the cause of failure of the safety valve is that the flow tube 62, although it will move down a distance sufficient to open the valve closure member 60, will not move to its full open position. In such event, the distance the flow tube is moved is measured so that the indentations can then be calculated and placed at a position to engage a downwardly directed shoulder of the housing so as to prevent the flow tube from closing.

While various types of tools may be provided to make the indentations, referring now to FIGS. 1A, 1B, 1C and 2, a suitable tool is indicated by the reference numeral 110 which is shown in a partially set position in solid lines and is shown in a further extended position in FIG. 1B in dotted outline. The tool 110 is lowered into the bore 56 of the safety valve 50 on a wireline 112 until a no-go shoulder 114 on the tool 110 engages a shoulder 116 on the valve 50. This aligns dogs 21 with a recess 118 in the housing 58 of the valve 50 and aligns dogs 5 in a recess 120 above the top 122 of the flow tube 62.

The tool 110 is jarred downwardly by a conventional jar to shear shear pin 1 to carry a collet 2 which is connected to the mandrel 8 by pin 3 for moving the dogs 21 outwardly into the recess 18. Simultaneously ratchet sleeve 19 which is connected to mandrel 8 by pin 7 moves downwardly to move the dogs 5 out of their windows and into the recess 120. The tool 110 is then picked up to insure that the dogs 21 and 5 are set, the weight noted and the elevation of the wireline 112 is marked at the well surface for future reference for determining the downward movement of the flow tube 62. The tool 110 is set back down on the shoulder 116 and jarred downwardly to shear pins 3 and 4. This allows the mandrel 8 to move down and carry lower lock housing 27 which is now released by shearing pin 4 and which carries the dogs 5 which are in a window in housing 27 to cause the dogs 5 to shoulder on the upper end 122 of the flow tube 62.

Further downward jarring of the tool 110 carries the mandrel 8 and mandrel sleeve 19 downwardly moving the flow tube 62 towards the open position. The ratchet segment 6 acts against the threads on the mandrel sleeve 19 to prevent upward travel of the flow tube 62. To insure that the flow tube has been moved to the open position, the tool 110 is picked up until the weight indicator reading indicates the same reading as obtained above. In addition, the distance marked on the wireline is measured to determine the distance that the flow tube 62 has traveled downwardly. Preferably, the flow tube 62 is moved downwardly the full extent of its downward travel.

After the flow tube downward travel has been achieved, the tool 110 is jarred upwardly to shear pin 7 which allows free upward movement of the mandrel 8. The mandrel 8 is then picked up compressing spring 18 through a pin 12 and sleeve 9. When the spring 18 reaches its solid height, the collet 11 will be aligned with and snapped into a groove 124 in member 10. However, caution must be taken at this time not to shear pin 12. Again jarring downwardly shears pin 13 and member 10 forces the pistons 14 outwardly by which indentations 100 (FIG. 1B) are made in the exterior circumference of the flow tube 62. Thus, when the tool 110 is removed, the indentations 100 will engage the downwardly directed shoulder 94 on the housing 58 preventing the flow tube 62 from moving upwardly to the closed position.

When the indentations have been made, the member 10 passes under the piston 14 until it shoulders the nose 15 at which time C-spring 16 snaps into a groove 17 which acts as a "tattle tail". That is, if maximum indentations is not achieved, the C-spring 16 will not be located in the groove 17 and when the tool 110 is retrieved, the tattle tail can be inspected through the hole 28 without having to disassemble the tool.

The tool 110 has been described in connection with making the plurality of circularly spaced indentations 100. In the event that it is desired to make either indentations 102 or 104, the vertical distance between the piston 14 and the dogs 5 would be spaced out to provide such indentations. Furthermore, in the event that the flow tube 62 becomes stuck and cannot be moved to the fully opened position (even though the valve closure member 60 is opened), it would be undesirable to proceed and make the indentations 100 as they would not then be positioned below the downwardly directed shoulder 94. In that event, the distance of downward travel of the flow tube 62 would be measured, the tool 110 removed and spaced out for placing indentations in the proper place in the tube 62 for engaging one of the downwardly directed shoulders in the housing 58. Again, the tool 110 would be run and the pistons 14 would be spaced relative to the dogs 5 to provide indentations at the desired location for engaging a downwardly directed shoulder in spite of the fact that the flow tube 62 was not extended fully.

In order to remove the tool 110, the tool is jarred upwardly to lift the sleeve 9 through pin 12 until spring 18 reaches its solid height and forces member 10 to shoulder with the ratchet mandrel 19. Continuing upward jarring shears the pin 12 and allows the mandrel 8 to move upwardly until the shoulder 20 engages collet 2. Further upward jarring releases the dogs 21 at which time collet 2 will shoulder with housing member 22. Further pickup causes shoulder 23 to engage shoulder 24 on the ratchet mandrel 19 and further pick up is continued until shoulder 25 engages shoulder 26 on the lock housing 27 at which time the lower dogs 5 are released. Continuing to pick up forces the piston 14 inwardly and the tool is retrieved. The spring 18 prevents the member 10 from moving downwardly and extending the piston 14.

The method of the present invention is apparent from the foregoing description. However, the method includes locking out a subsurface well safety valve in the open position in which the valve includes a housing having a bore and at least one downwardly directed shoulder adjacent the bore and a valve closure member in the bore moving between open and closed positions, a flow tube telescopically movable in the housing for controlling the movement of the valve closure member and means for operating the flow tube. The method includes moving the flow tube towards an open position, and from the inside of the bore making an outward indentation in the flow tube wherein the indentation will engage a downwardly directed shoulder in the housing thereby preventing the flow tube from moving to the closed position. The method includes making a plurality of indentations about the outer circumference of the flow tube and further includes wherein the indentations are placed a predetermined distance from the top of the flow tube and includes wherein the indentations are circularly positioned. The method further includes measuring the distance the flow tube is moved prior to making the indentations.

The present invention, therefore, is well adapted to carry out the objects and attain the ends and advantages mentioned as well as others inherent therein. While a presently preferred embodiment of the invention has been given for the purpose of disclosure, numerous changes in the details of construction, arrangement of parts and steps of the method may be provided, without departing from the spirit of the invention and the scope of the appended claims.

What is claimed is:

1. A method of locking out a subsurface well safety valve in the open position in which the valve includes a housing having a bore and at least one downwardly directed shoulder adjacent the bore and a valve closure member in the bore moving between open and closed positions, a flow tube telescopically movable in the housing for controlling the movement of the valve closure member, and means for operating the flow tube comprising, moving the flow tube toward its open position, from the inside of the bore making an outward indentation in the flow tube whereby the indentation will engage a downwardly directed shoulder on the housing thereby preventing the flow tube from moving to the closed position.

2. The method of claim 1 including, making a plurality of indentations about the outer circumference of the flow tube.

3. The method of claim 2 wherein the indentations are circularly positioned.

4. The method of claim 1 wherein the indentation is placed a predetermined distance from the top of the flow tube.

5. The method of claim 1 including, moving the flow tube downwardly by engaging and mechanically moving the flow tube.

6. The method of claim 1 including, measuring the distance the flow tube is moved.

7. A method of locking out a subsurface well safety valve in the open position in which the valve includes a housing having a bore and at least one downwardly directed shoulder adjacent the bore, and a valve closure member in the bore moving between open and closed positions, a flow tube telescopically movable in the housing for controlling the movement of the valve closure member, and means for operating the flow tube comprising, engaging the flow tube from the bore, moving the flow tube toward the open position opening the valve closure member, measuring the distance the flow tube is moved, from the inside or the bore making one or more outward indentations in the flow tube a predetermined distance from the top of the flow tube whereby the indentations will engage a downwardly directed shoulder on the housing thereby preventing the flow tube from moving to the closed position.

8. Means for locking out a subsurface safety valve in the open position in which the valve includes a housing having a bore and at least one downwardly directed shoulder adjacent the bore, and a valve closure member in the bore moving between open and closed positions, a flow tube telescopically movable in the housing for controlling the movement of the valve closure member, comprising, a body adapted to move into the bore of the safety valve, means on the body adapted to engage the flow tube and move the flow tube toward the open position, and means on the body for making at least one outward indentation in the flow tube at a predetermined location in the flow tube.

9. The apparatus of claim 3 including, means for making the indentation in a predetermined distance from the top of the flow tube.

10. The apparatus of claim 9 including, means for measuring the distance the flow tube is moved.

* * * * *

UNITED STATES PATENT OFFICE

CERTIFICATE OF CORRECTION

Patent No. 4,574,889 Dated March 11, 1986

Inventor(s) Ronald E. Pringle

It is certified that error appears in the above-identified patent and that said Letters Patent are hereby corrected as shown below:

Column 7, line 4, change "or" to -- of --

Signed and Sealed this

*Eighth* Day of *July 1986*

[SEAL]

*Attest:*

DONALD J. QUIGG

*Attesting Officer*

*Commissioner of Patents and Trademarks*